US005321587A

United States Patent [19]

Fujita

[11] Patent Number: 5,321,587

[45] Date of Patent: Jun. 14, 1994

[54] CHEMILUMINESCENCE DEVICE

[75] Inventor: Masahiko Fujita, Munakata, Japan

[73] Assignee: Nihon Kagaku Hakkou K.K., Fukuoka, Japan

[21] Appl. No.: 91,925

[22] Filed: Jul. 16, 1993

[51] Int. Cl.[5] ..... F21K 2/06

[52] U.S. Cl. ..... 362/34; 362/84; 206/524.1; 206/806

[58] Field of Search ..... 362/34, 84; 206/524.1, 206/806

[56] References Cited

U.S. PATENT DOCUMENTS 4,184,193 1/1980 Heffernan et al. ..... 362/34
5,043,851 8/1991 Kaplan ..... 362/34

*Primary Examiner*—Ira S. Lazarus
*Assistant Examiner*—L. Heyman
*Attorney, Agent, or Firm*—Armstrong, Westerman, Hattori, McLeland & Naughton

[57] ABSTRACT

A chemiluminescence device includes a cylindrical, transparent, and flexible container having a hollow and a groove capable of clamping articles in the form of a stick, a pipe, a wire, a line or the like. An ampule is provided in the hollow of the container and has a hollow breakable at a time of breaking the seal thereof. Two liquid substances for chemiluminescence are contained in the hollows of the container and the ampule, respectively, and are capable of performing chemiluminescence when mixed with each other in the container. The groove has an opening whose width is smaller than a bore of the groove, so that the groove is capable of clamping the article to be attached by elastic force from the container. A holder can be used for preventing the chemiluminescence device from dropping from the article.

8 Claims, 6 Drawing Sheets

FIG. 10
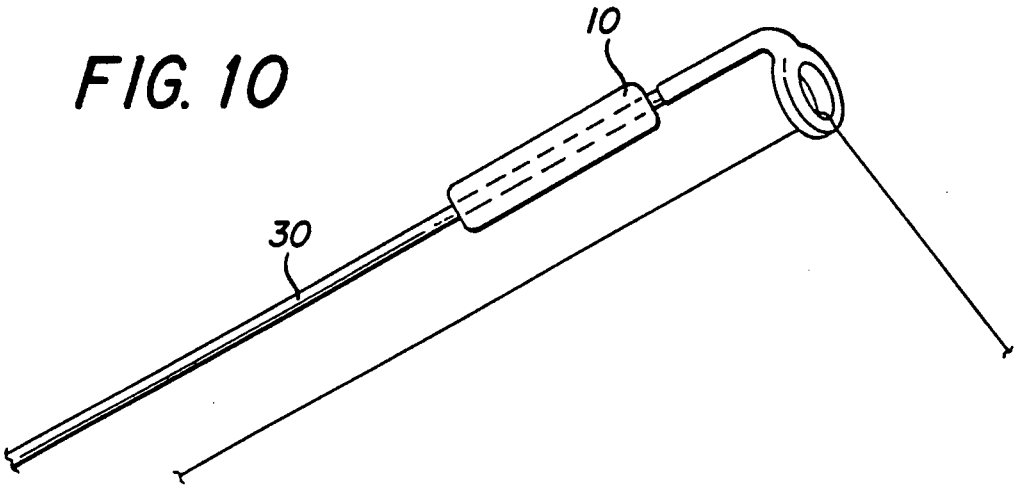
FIG. 11
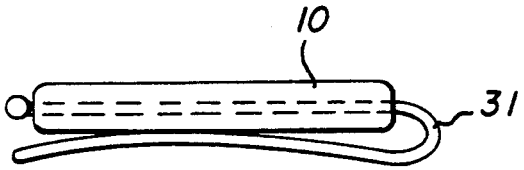
FIG. 12
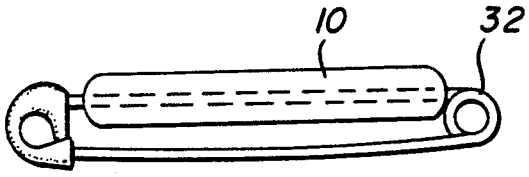
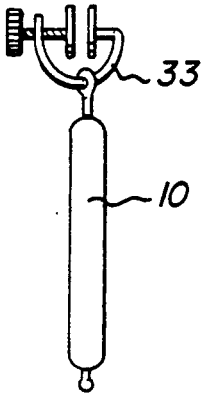
FIG. 13

CHEMILUMINESCENCE DEVICE

BACKGROUND OF THE INVENTION

1. Field of the Invention

This invention relates to a chemiluminescence device widely applicable to fishing gears, alarm apparatuses, signs, personal ornaments, toys and the like.

2. Description of Related Art

Almost all of chemiluminescence devices, or apparatuses for illuminations, attractions and personal ornaments, are formed in a stick type luminous body, or a cylindrical shaped transparent tube, including two types chemiluminescence liquid substances. The chemiluminescence liquid substances assume chemiluminescence when mixed. The tube contains one of the chemiluminescence liquid substances as it is in a liquid phase and an ampule filled with the other of the chemiluminescence liquid substances. To let the device luminesce, sealing of the ampule is broken by bending the tube, so that the two chemiluminescence liquid substances are mixed to begin chemiluminescence phenomena.

The two chemiluminescence liquid substances are generally fluorescent liquid and oxidizing liquid. The fluorescent liquid is composed of dibutyl phthalate, fluorescent substance, and reaction substance. The oxidizing liquid is composed of dimethyl phthalate, hydrogen dioxide, sodium salicylate and the like. The chemiluminescence liquid substances are not restricted to those components.

Since such a conventional chemiluminescence device is in a form of stick type body, when attached to an article, the device requires a special attachment. This leads an inconvenience in use of the device. For example, in the case when the conventional chemiluminescence device is attached to a rope, a wire, or the like, such a rope is threaded through a hollow of a pair of elastic tubes in advance, and then, both ends of the stick shaped chemiluminescence device are held by the tubes, otherwise the device is wrapped together with a rope by a tape.

SUMMARY OF THE INVENTION

It is an object of the invention to provide a chemiluminescence device readily attachable to articles in the form of a line, a wire, a rope, a pipe, or other similar shaped goods, tough to fall off against exertion of external force of, for instance, wind, water flow and the like, changeable of chemiluminescence color thereof, and capable of appealing letters and pictures.

The foregoing object is accomplished with a chemiluminescence device including a cylindrical, transparent, and flexible container having a hollow and a groove capable of clamping an article to be attached, an ampule provided in the hollow of the container, having a hollow breakable at a time of breaking the seal thereof, and two liquid substances for chemiluminescence contained in the hollows of the container and the ampule, respectively. The groove faces a circumferential face of the container via an opening, whose width is smaller than a bore of the groove so that the groove is capable of clamping the article. The article to be attached is in the form of a stick, a pipe, a wire, a line or the like. The two liquid substances for chemiluminescence are capable of chemiluminescence when mixed with each other.

According to a preferred embodiment, the chemiluminescence device further includes a holder constituted of a transparent or semitransparent material in a pipe shape with a slit having an inner diameter fitting to the outside of the container. The holder may include an organic fluorescent substance, and may have a letter or a picture on a surface thereof.

BRIEF DESCRIPTION OF THE DRAWINGS

The above and other objects and features of the invention are apparent to those skilled in the art from the following preferred embodiments thereof when considered in conjunction with the accompanied drawings, in which:

FIGS. 6 to 10 are side illustrations showing fishing gears to which the chemiluminescence device according to the invention is adapted;

FIGS. 11 to 13 are side illustrations showing personal ornaments to which the chemiluminescence device according to the invention is adapted;

DETAILED DESCRIPTION OF THE PREFERRED EMBODIMENTS

Figure 1:
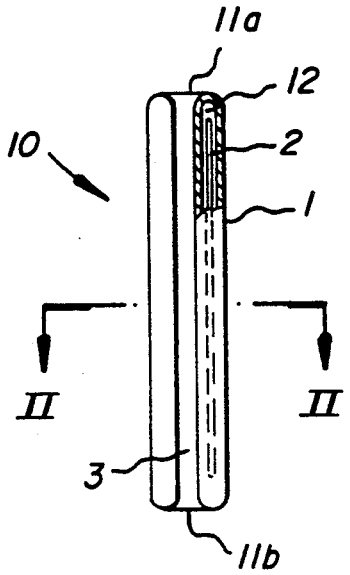
FIG. 1 is an elevational illustration, partially broken away, showing a chemiluminescence device according to a preferred embodiment of the invention.
Figure 2:
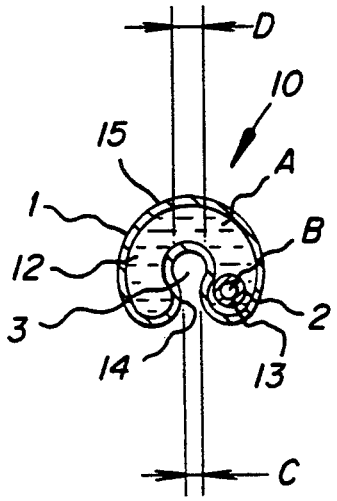
FIG. 2 is a cross-sectional illustration taken along line II—II of FIG. 1 showing the cross section of the chemiluminescence device.

Referring to the drawings in detail, in particular, to FIGS. 1, 2, a chemiluminescence device, designated by reference numeral 10, according to a preferred embodiment of the invention, is shown.

The chemiluminescence device 10 includes a flexible, transparent synthetic resin container 1 made of a film of a group of polyolefin, such as polyethylene, or polypropylene, so as to form a hollow 12 therein. The synthetic resin container 1 has a substantially cylindrical shape extending in a longitudinal, or vertical, direction between top and bottom ends 11*a*, 11*b*, which are located in opposition to each other. The synthetic resin container 1 has a groove 3 as a recession indented from a circumferential face 15 thereof. The groove 3 is defined by an inner face extending in the longitudinal direction between the top and bottom ends 11*a*, 11*b*. The cross-sectional contour of the synthetic resin container 1 is formed in a hoofed shape on a plane perpendicular to the longitudinal direction. The hollow 12 extends in the longitudinal direction and has a hoofed cross-sectional shape as well as the cross-sectional contour of the container 1. The hollow 12 contains a thin ampule 2 in a cylindrical shape and is filled with fluorescent liquid A, one of chemiluminescence liquid substances to perform chemiluminescence. The ampule 2 is made of glass so that the seal of the ampule 2 can be broken when the ampule 2 is collapsed. The ampule 2 is filled with oxidizing liquid B, the other of chemiluminescence liquid substances to perform chemiluminescence, in a hollow 13 thereof. The fluorescent liquid. A is composed of dibutyl phthalate, fluorescent substance, and reaction substance. The oxidizing liquid B is composed of dimethyl phthalate, hydrogen dioxide, sodium salicylate and the like. Other components of those liquids for chemiluminescence are possible. The hollow 12 can contain two or greater number of arepules 2.

Since an opening 14 of the groove 3 has a width C smaller than a bore D of the groove 3, and the synthetic resin container 1 filled with the fluorescent liquid A serves as an elastic body, the groove 3 is capable of clamping an article, such as a rope, a wire, a line, a pipe and the like, to which the chemiluminescence device 10 is attached. To be attached to such an article, the chemiluminescence device having the bore D a little smaller than the diameter of the article is employed. When attached to the article, the opening 14 is widely stretched so as to allow the article to pass the opening 14, and then the article is clamped by the groove 3 using elastic force of the synthetic resin container 1.

Before or after the chemiluminescence device 10 is attached to the article, the ampule 2 in the chemiluminescence device 10 is broken to spill out the oxidizing liquid B contained therein, so that the oxidizing liquid B and the fluorescent liquid A are mixed together so that the chemiluminescence device 10 assumes chemiluminescence phenomenon. Since the synthetic resin container 1 is made of a flexible material, the ampule 2 in the synthetic resin container 1 is readily broken by bending the ampule 2 together with the synthetic resin container 1 using operator's hand without touching directly to the ampule 2. Since the synthetic resin container 1 is made of a transparent material, the chemiluminescence phenomenon can readily be seen even though it occurs within the synthetic resin container 1.

Figure 3:
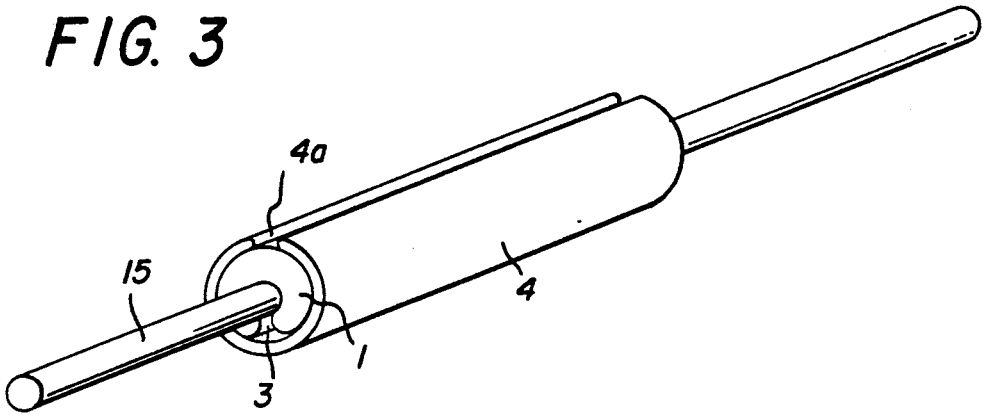
FIGS. 3 to 5 are perspective illustrations showing a holder and container of the invention.
Figure 4:
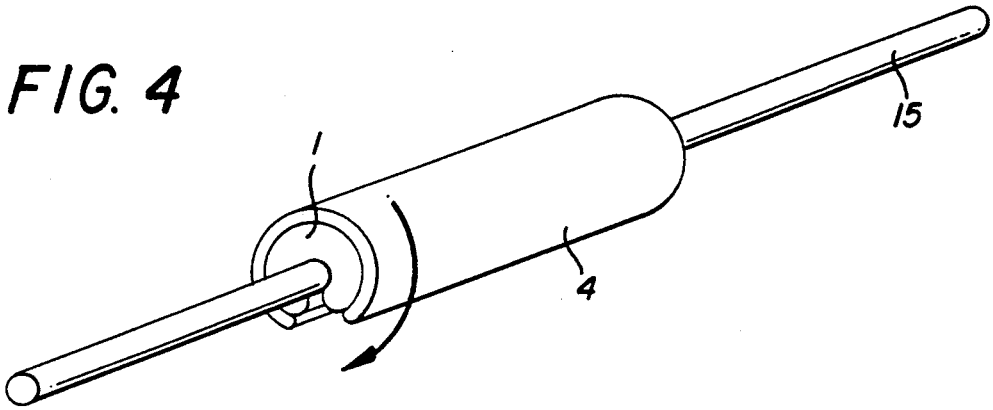
Figure 5:
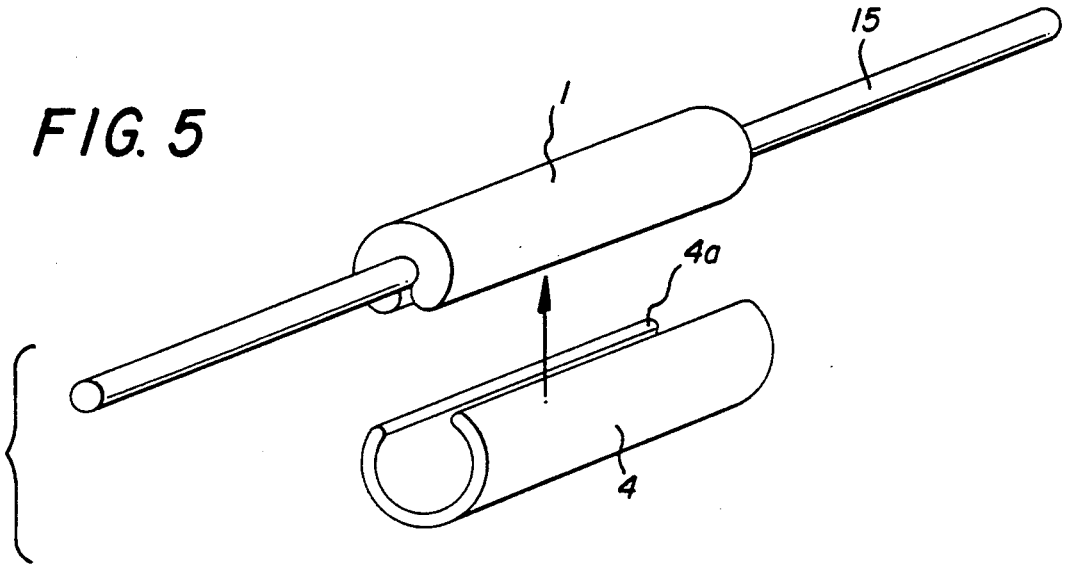

Although the chemiluminescence device 10 is not easily detached from the article, such as a rope or a wire, at a time that the article is clamped by the elastic force of the synthetic resin container 1, the chemiluminescence device 10 may be detached from the article at a time that extraordinary external force is exerted to the chemiluminescence device. To avoid such a problem, the chemiluminescence device according to the invention can be used with a holder 4 made of a transparent or semitransparent material in a pipe shape to surround the synthetic resin container 1 of the chemiluminescence device, as shown in FIG. 3. The material for forming the holder 4 is rigid enough to hold the synthetic resin container 1. The holder 4 has a slit 4*a* extending in the longitudinal direction for widening a bore of the holder 4. The bore of the holder 4 is a little smaller than the diameter of the synthetic resin container 1 in a normal situation. Therefore, when the slit 4*a* is widened, elastic force trying to reform into the original form occurs, and in the case that the container 1 holding the article 15 is held by the holder 4, the elastic force is used as clamping force for the article 15. The slit 4*a* is also used to allow the article 15 or the synthetic resin container 1 with the article 15 to pass therethrough, as shown in FIGS. 4, 5.

The holder 4 can contain organic fluorescent materials for shifting a wave length of light generated by chemiluminescence phenomenon in the synthetic resin container 1 to a wave length longer than the original. For example, if liquid of 1-chloro-9,10-bis(phenylethynyl)-anthracene is used as liquid in the synthetic resin container 1, the wave length of chemiluminescence is 520 nano meters. The wave length can be converted to 600 to 615 nano meters, wave length in a red range, if the wall of the holder 4*a* contains an organic red fluorescent substance, for example such as, 1,4 dichloro-5,12-bis(phenylethynyl)-naphthacene (DCBPEN) or aryloxine-substituted perylene-3,4,9,10-tetracarboxylic acid diimide.

The holder 4 can be adapted to all examples described below and may be formed with letters and pictures, and the like for the purpose of attracting human's eyes, as described below.

Figure 6:
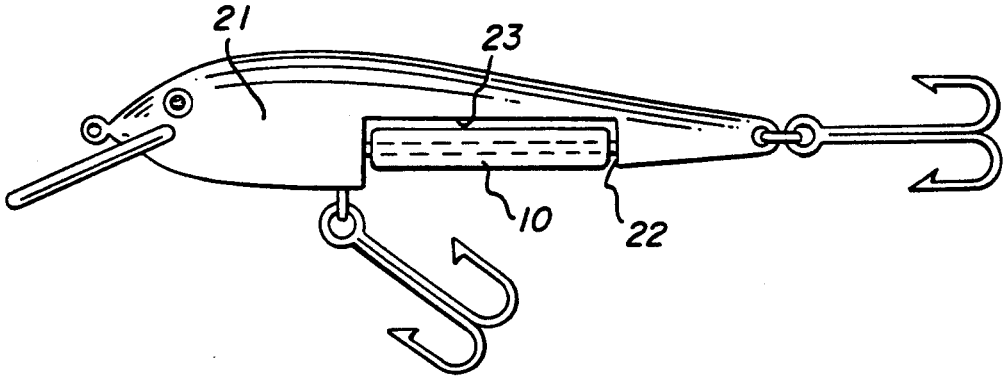
Figure 7:
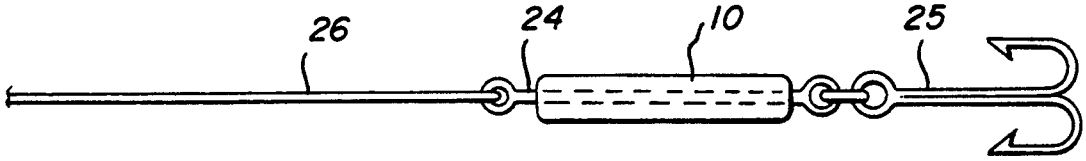
Figure 8:
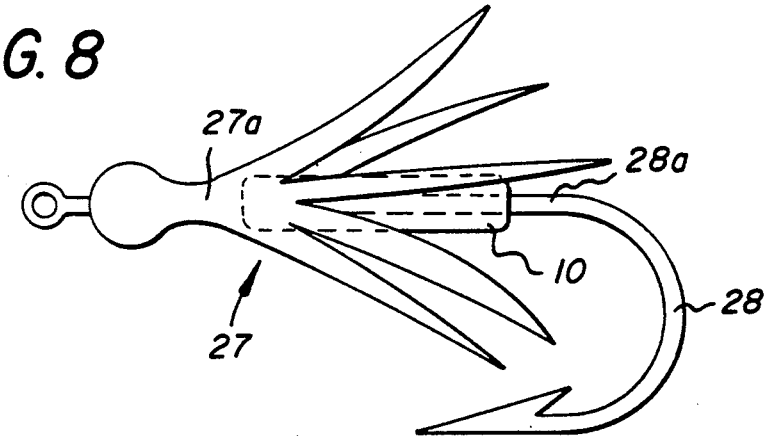
Figure 9:
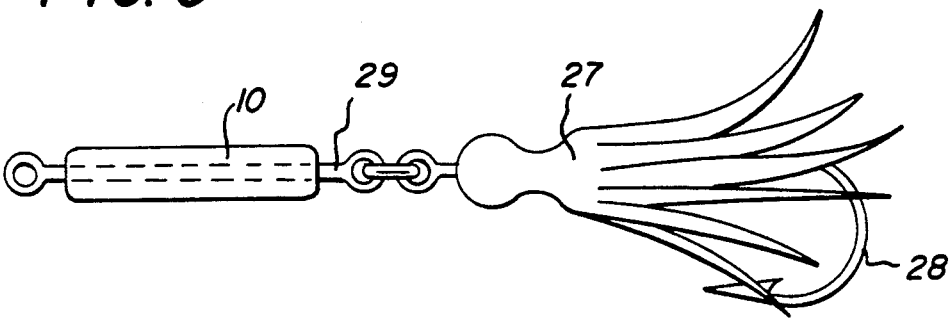

Referring to FIGS. 6 to 18, examples of application of the chemiluminescence device according to the invention are illustrated. Referring to FIGS. 6 to 10, examples for fishing gears are shown. In FIG. 6, a lure 21 designed in a fish shape has a wire 22 at an indentation 23 of a belly portion thereof, and. the chemiluminescence device 10 is attached to the wire 22. Using this lure, movement of the lure 21 and chemiluminescence of the chemiluminescence device 10 attract attentions of fish, so that the user of the lure 21 can catch many fish. In FIG. 7, the chemiluminescence device 10 is attached to a metal connector 24 in the form of a wire arranged between a pair of rings. The metal connector 24 is provided between a fishing hook 25 and a fishing line 26. In FIG. 8, the chemiluminescence device 10 is attached to a jig having 27 an octopus shaped body 27*a* made of a soft material. A hook 28 is assembled on a tail side of the jig 27 and the chemiluminescence device 10 is attached to a shank 28*a* of the hook 28. In this example, the chemiluminescence device 10 is inserted in the octopus shaped body 27*a*, so that mixing dyes and pigments into the soft material of the octopus shaped body 27*a* allows the luminescent color of the jig 27 to be chosen freely. This octopus shaped body 27*a* mixed with dyes and pigments functions as well as the holder 4 described above. In FIG. 9, the chemiluminescence device 10 is attached to a metal connector 29, which is connected to the jig 27 shown in FIG. 8. In FIG. 10, the chemiluminescence device 10 is attached to a tip of a fishing rod 30 as an indicator. Since the chemiluminescence device 10 is attached closely so as to surround the tip of the fishing rod 30, this fishing gear can avoid troubles such as entanglements of the fishing line. Since the chemiluminescence device 10 is attached to the tip of the fishing rod 30, the movement of the fishing rod 30 is easily recognized even at a time of dark situations.

Referring to FIGS. 11 to 13, examples for personal ornaments are illustrated. In FIG. 11, the chemiluminescence device 10 is attached to a hair pin 31 as one example of hair accessories. In FIG. 12, the chemiluminescence device 10 is attached to a safety pin 32. Using this application, the chemiluminescence device 10 can readily be attached to clothes including clothes for the military, and other things. In FIG. 12, the chemiluminescence device 10 is attached to a shank of an ear ring 33.

Figure 14:
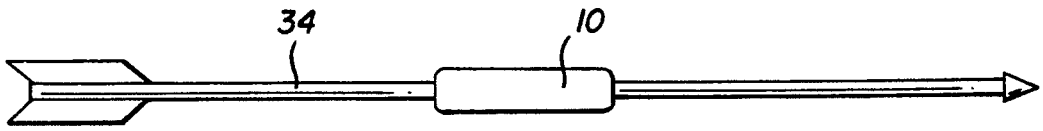
FIG. 14 is a side illustration showing an arrow to which the chemiluminescence device according to the invention is adapted.
Figure 15:
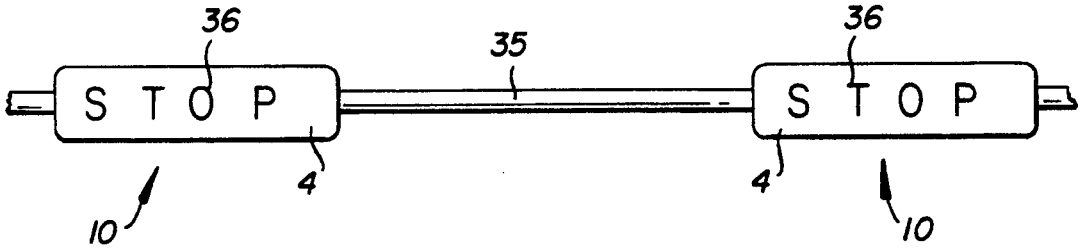
FIG. 15 is a side illustration showing a sign to which the chemiluminescence device according to the invention is adapted.
Figure 18:
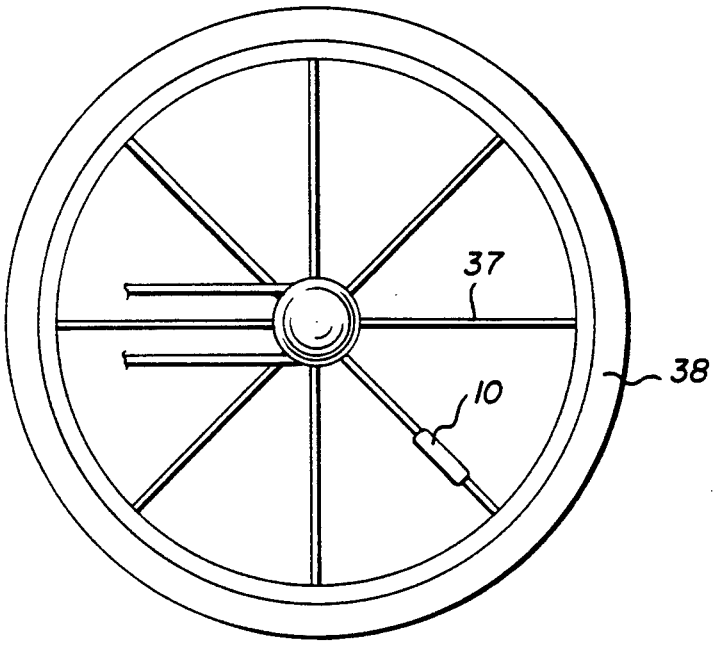
FIG. 18 is a side illustration showing a wheel of a bicycle to which the chemiluminescence device according to the invention is adapted.
Figure 16:
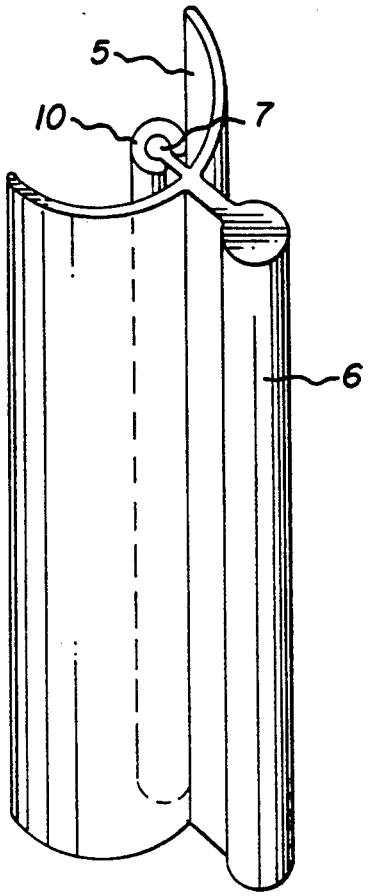
FIGS. 16 and 17 are perspective illustrations showing apparatus for illumination using the chemiluminescence device.
Figure 17:
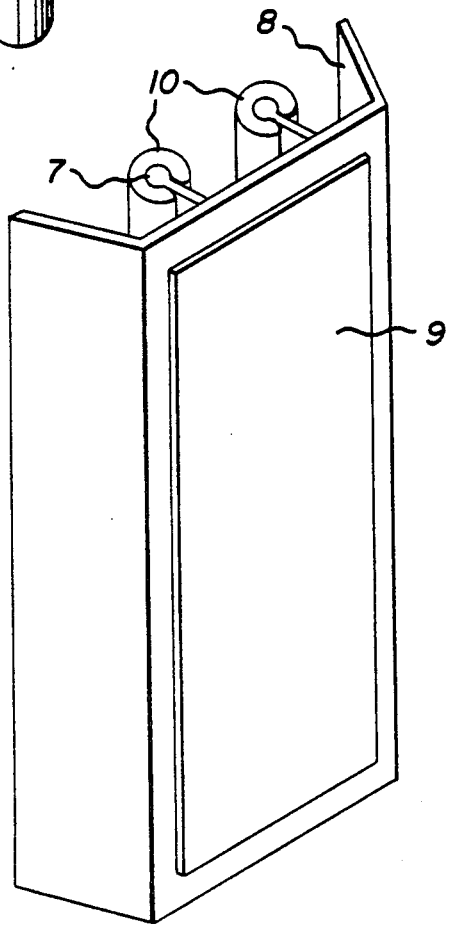

Referring to FIGS. 14 to 18, examples for signs and others are illustrated. In FIG. 14, the chemiluminescence device 10 is attached to around the center of gravity of an arrow 34. In FIG. 15, a plurality of the chemiluminescence devices 10 are attached to a rope 35. The chemiluminescence devices 10 are arranged with the holders 4, respectively. The chemiluminescence devices 10 include red fluorescent substances in their wall and are written with black letters as seen "STOP." The chemiluminescence devices 10 are used for stop signs. In FIG. 16, an apparatus for illumination is shown. A grip 6 is formed at a back of a light reflector 5, and a protruding portion 7 adapted for the form of the groove 3 of the chemiluminescence device 1 is disposed at the center of the light reflector 5. To use the apparatus for illumination, the chemiluminescence device 10 is fitted to the protruding portion 7. In FIG. 17, another apparatus for illumination is shown. A pair of the protruding portions 7 described above are arranged at the light reflecting board 8 in parallel relationship with each other. Each chemiluminescence device 10 is attached to each protruding portion 7. A double-sided adhesive tape 9 is attached to the back face of the light reflecting board 8. When the apparatus is about to be used, a stripping paper is peeled off the double-sided adhesive tape 9, and then the apparatus is attached to a position at which the apparatus is used. In FIG. 18, the chemiluminescence device 10 is attached to a spoke 37 of a wheel 38 of a bicycle. The chemiluminescence device 10 helps in safety running at night.

As described above, the chemiluminescence device 10 according to the invention can be attached to and detached from the articles in the forms of ropes, sticks, pipes and the like quite readily. When prevention of falling the chemiluminescence device is needed, the holder 4 makes attachment of the device assured. Preparing variety of colors of the holder 4 allows favor choices of colors luminescent in the case that the chemiluminescence color from the container 1 is to be changed. Letters and pictures on the holder 4 give effective attentions to those who looking at the chemiluminescence device 10.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A chemiluminescence device attachable to articles in the form of a stick, a pipe, a wire, a line or the like, and capable of performing chemiluminescence, said chemiluminescence device comprising:

a container constituted of a transparent, flexible material, said container extending in a longitudinal direction between ends thereof in opposition to each other and having a hollow therein and a substantially cylindrical configuration with a groove extending in said longitudinal direction, said groove defining an opening having width smaller than a bore of said groove so that said groove is capable of clamping the articles to be attached;

an ampule provided in said hollow of said container, having a hollow whose seal is breakable; and two liquid substances for chemiluminescence at a time that mixed with each other, contained in said hollow of said container and in said hollow of said ampule, respectively.

2. A chemiluminescence device as set forth in claim 1, further comprising a holder constituted of a transparent or semitransparent material in a pipe shape with a slit having an inner diameter fitting to the outside of said container.

3. A chemiluminescence device as set forth in claim 2, wherein said holder includes an organic fluorescent substance.

4. A chemiluminescence device as set forth in claim 2, wherein said holder has a letter or a picture on a surface thereof.

5. A chemiluminescence device as set forth in claim 1, wherein said material is a resin of a group of polyolefin.

6. An apparatus for illumination comprising;

a chemiluminescence device comprised of a container constituted of a transparent, flexible material, said container extending in a longitudinal direction between ends thereof in opposition to each other and having a hollow therein and a substantially cylindrical configuration with a groove extending in said longitudinal direction, said groove defining an opening having a width smaller than a bore of said groove so that said groove is capable of clamping an article to be attached;

reflecting means for reflecting the light from the chemiluminescence device formed with a reflecting face thereof;

at least one of protruding portions formed so as to be clamped by the groove of the chemiluminescence device and disposed at said reflecting face.

7. An apparatus for illumination as set forth in claim 6, further comprising a grip disposed at the back of said reflecting means.

8. An apparatus for illumination as set forth in claim 6, further comprising a double sided adhesive tape disposed at the back of said reflecting means.

* * * * *